US005870113A

United States Patent [19]

Koizumi

[11] Patent Number: 5,870,113

[45] Date of Patent: Feb. 9, 1999

[54] LIQUID JET RECORDING APPARATUS AND METHOD USEABLE WITH REMOVABLE RECORDING HEAD

[75] Inventor: Yutaka Koizumi, Hiratsuka, Japan

[73] Assignee: Canon Kabushiki Kaisha, Tokyo, Japan

[21] Appl. No.: 243,523

[22] Filed: May 16, 1994

Related U.S. Application Data

[60] Continuation of Ser. No. 44,492, Apr. 9, 1993, abandoned, which is a division of Ser. No. 866,280, Apr. 13, 1992, Pat. No. 5,235,351, which is a continuation of Ser. No. 708,813, May 31, 1991, abandoned, which is a continuation of Ser. No. 401,548, Aug. 31, 1989, abandoned, which is a continuation of Ser. No. 77,993, Jul. 24, 1987, abandoned, which is a continuation of Ser. No. 712,748, Mar. 18, 1985, abandoned.

[30] Foreign Application Priority Data

Mar. 31, 1984 [JP] Japan ..... 59-64113
Mar. 31, 1984 [JP] Japan ..... 59-64114

[51] Int. Cl.[6] ..... B41J 2/05

[52] U.S. Cl. ..... 347/14; 347/19; 347/49

[58] Field of Search ..... 347/19, 14, 49; 400/175; 346/139 C

[56] References Cited

U.S. PATENT DOCUMENTS

| | | | |
|---|---|---|---|
| 4,030,588 | 6/1977 | Hanagata et al. | 197/1 R |
| 4,281,938 | 8/1981 | Philips | 400/171 |
| 4,296,421 | 10/1981 | Hara et al. | 346/140 R |
| 4,370,666 | 1/1983 | Noda et al. | 346/76 PH |
| 4,386,862 | 6/1983 | Kittel et al. | 400/144.2 |
| 4,396,923 | 8/1983 | Noda | 346/76 PH |
| 4,411,540 | 10/1983 | Nozaki et al. | 400/175 |
| 4,448,555 | 5/1984 | Hasegawa | 400/144.2 |
| 4,500,195 | 2/1985 | Hosono | 355/3 R |
| 4,554,559 | 11/1985 | Heath | 346/76 PH |
| 4,746,936 | 5/1988 | Takahashi | 346/140 R |
| 4,803,521 | 2/1989 | Honda | 355/14 R |

OTHER PUBLICATIONS

Okcuoglu et al., "Pitch Sensing Device", IBM Technical Disclosure Bulletin, vol. 24, No. 1A, Jun. 1981.

Lonis, "Storage of Operating Parameters In Memory Integral With Printhead", Xerox Disclosure Journal, vol. 8, No. 6, Nov./Dec. 1983.

*Primary Examiner*—Joseph W. Hartary

*Attorney, Agent, or Firm*—Fitzpatrick, Cella, Harper & Scinto

[57] ABSTRACT

A liquid jet recording apparatus utilizes a removable recording head that stores its operation data. The apparatus includes a carriage, a detector, a read-out device and a controller. The carriage removably mounts the recording head. The detector detects mounting of the recording head on the carriage. The read-out device reads out the operation data of the recording head mounted on the carriage in response to detecting of mounting by the detector. The controller sense an operation condition of the recording head mounted on the carriage in response to the read-out device.

23 Claims, 9 Drawing Sheets

LIQUID JET RECORDING APPARATUS AND METHOD USEABLE WITH REMOVABLE RECORDING HEAD

This application is a continuation of application Ser. No. 08/044,492 filed Apr. 9, 1993, now abandoned, which in turn is a division of application Ser. No. 07/866,280 filed Apr. 13, 1992, now U.S. Pat. No. 5,235,351, which in turn is a continuation of application Ser. No. 07/708,813 filed May 31, 1991, now abandoned, which in turn is a continuation of application Ser. No. 07/401,548 filed Aug. 31, 1989, now abandoned, which in turn is a continuation of application Ser. No. 07/077,993 filed Jul. 24, 1987, now abandoned, which in turn is a continuation of application Ser. No. 06/712,748 filed Mar. 18, 1985, now abandoned.

BACKGROUND OF THE INVENTION

1. Field of the Invention

This invention relates to a liquid ejection recording apparatus for ejecting flying droplets to a recording medium and recording character images or the like thereon and to a liquid ejection recording head used in such apparatus, and more particularly, to a liquid ejection recording head suitable for being removably mounted on a carriage scanning relative to the recording medium and to a liquid ejection recording apparatus in which a driving voltage for driving the liquid ejection recording head is adjustable for each liquid ejection recording head.

2. Description of the Prior Art

The non-impact recording methods have recently drawn attention in that the occurrence of noise during the recording is negligibly small. Among them, the ink jet recording method (the liquid ejection recording method) which is capable of accomplishing high-speed recording and moreover, can accomplish full color printing without requiring a special process of fixation for recording on plain paper is a very effective recording method, and various types of such recording method have heretofore been proposed and some of them have already put into commercial use and some of them are still being studied.

Such liquid ejection recording method effects the recording by causing droplets of recording liquid called ink to fly and adhere to a recording medium, and may be divided broadly into several types by the method of forming the droplets of the recording liquid and the method of controlling the direction of flight of the formed droplets.

Among them, the liquid ejection recording methods disclosed, for example, in U.S. Pat. No. 3,683, 212, U.S. Pat. No. 3,747,120 and U.S. Pat. No. 3,946,398 are the so-called drop-on-demand recording method in which droplets are discharged from discharge orifices in accordance with a recording signal and these droplets are caused to adhere to the surface of a recording medium to thereby accomplish the recording. In this recording method, only the droplets necessary for the recording are discharged and therefore, it is not necessary to install any special means for recovering or treating the discharged liquid un-necessary for the recording and thus, the apparatus itself can be made simple and compact and nowadays, this recording method particularly attracts attention due to the fact that it is unnecessary to control the direction of flight of droplets discharged from discharge orifices and the fact that multi-color recording can be accomplished easily.

A liquid ejection recording method entirely different from the above-described liquid ejection recording method in the principle of formation of flying droplets is disclosed in Japanese Laid-Open Patent Application No. 51837/1979. This liquid ejection recording method is not only very effectively applicable to said drop-on-demand recording method, but also can easily realize a highly dense multi-orifice recording head, and therefore, it has a feature that recorded images of high resolution and high quality can be obtained at a high speed.

The liquid ejection recording apparatus used in these drop-on-demand recording methods is usually of a structure having a recording head comprised of discharge ports (orifices) for discharging droplets, liquid flow paths communicating with the orifices and having energy generating elements for forming flying droplets, and a liquid chamber communicating with the liquid flow paths and storing therein liquid to be supplied to these flow paths.

However, in the liquid ejection recording apparatus having the construction as described above, the optimum driving voltages inherent to the liquid ejection recording heads thereof are different and irregular, and therefore, it is necessary to adjust a driving voltage generating circuit in the liquid ejection recording apparatus in accordance with the optimum driving voltage inherent to the liquid ejection recording head.

If this adjustment is neglected, the following problem will arise. That is, when a liquid ejection recording head whose inherent voltage is higher than the driving voltage supplied from the driving voltage generating circuit of the liquid ejection recording apparatus is mounted on the recording apparatus, stable flying droplets cannot be obtained or, in the worst case, droplets cannot be discharged. Conversely, when a liquid ejection recording head whose inherent voltage is lower than the driving voltage supplied from the driving voltage generating circuit of the liquid ejection recording apparatus is mounted on the recording apparatus, unnecessary droplets, called satellities, are secondarily ejected or an excessively great load is applied to the energy generating elements to remarkably reduce their service life, and in the worst case, the energy generating elements may be destroyed.

Accordingly, when the liquid ejection recording head is to be interchanged by reason of trouble with it or the like, a high-degree of maintenance work which requires a part of the driving voltage generating circuit to be changed becomes necessary, and this has led to a problem that the manufacturer must make expensive liquid ejection recording heads whose trouble rate is very low.

In fact, in the liquid ejection recording apparatus of this type, the liquid ejection recording head (hereinafter referred to simply as the head) has often been interchanged from the viewpoint of securing the reliability of the head. However, each head has its inherent optimum driving voltage and the value of that voltage differs from head to head, and therefore, it has been necessary to adjust the driving voltage generating circuit in the liquid ejection recording apparatus in accordance with the optimum driving voltage value of the head.

Thus, each manufacturer has shown the optimum driving voltage value by directly writing the voltage value on the head or by sticking, on the head, a label on which the optimum driving voltage value is written.

Therefore, when actually interchanging the head, a cumbersome procedure wherein, according to the voltage value written or stuck on the head, the operator such as the user or serviceman most adjust the driving voltage generating circuit on the basis of a corresponding table, or the like, which must be resorted to. Also, the voltage value directly written on the head is apt to fade away during the transportation or the label stuck on the head may peel off during transportation, and this has led to the occurrence of a trouble that the driving voltage value becomes unknown.

SUMMARY OF THE INVENTION

It is an object of the present invention to eliminate the above-noted disadvantages and to provide a liquid ejection recording head having an accurate and clear driving voltage display which can be automatically read.

It is another object of the present invention to provide a liquid ejection recording apparatus in which the driving voltage display of the liquid ejection recording head can be read to adjust the driving voltage to a level suitable for individual liquid ejection recording heads and thereby ensure stable image recording.

It is still another object of the present invention to provide a liquid ejection recording head in which the value of the optimum driving voltage supplied to energy generating members for forming flying droplets is symbolized and recorded at a predetermined location on the head.

It is yet another object of the present invention to provide a liquid ejection recording apparatus having a liquid ejection recording head provided with discharge ports and energy generating members for generating energy used to discharge liquid and form flying droplets, and a carriage for mounting said liquid ejection recording head thereon and wherein reading means is provided for reading the symbol of a driving voltage value supplied to said energy generating members which is symbolized and recorded on said liquid ejection recording head.

It is a further object of the present invention to provide a liquid ejection recording apparatus which comprises a liquid ejection recording head having energy generating members for generating energy utilized to form flying droplets and a symbol recording the value of a driving voltage supplied to said energy generating members, voltage generating means for generating said driving voltage supplied to said energy generating members, reading means for reading the recorded content of said symbol, and control means for controlling the voltage of said voltage generating means in accordance with said recorded content read by said reading means and in which the adjusting operation during the mounting and the interchange of said recording head is easy.

DESCRIPTION OF THE PREFERRED EMBODIMENTS

The liquid ejection recording head of the present invention will hereinafter be described in detail with reference to the drawings.

Figure 1:
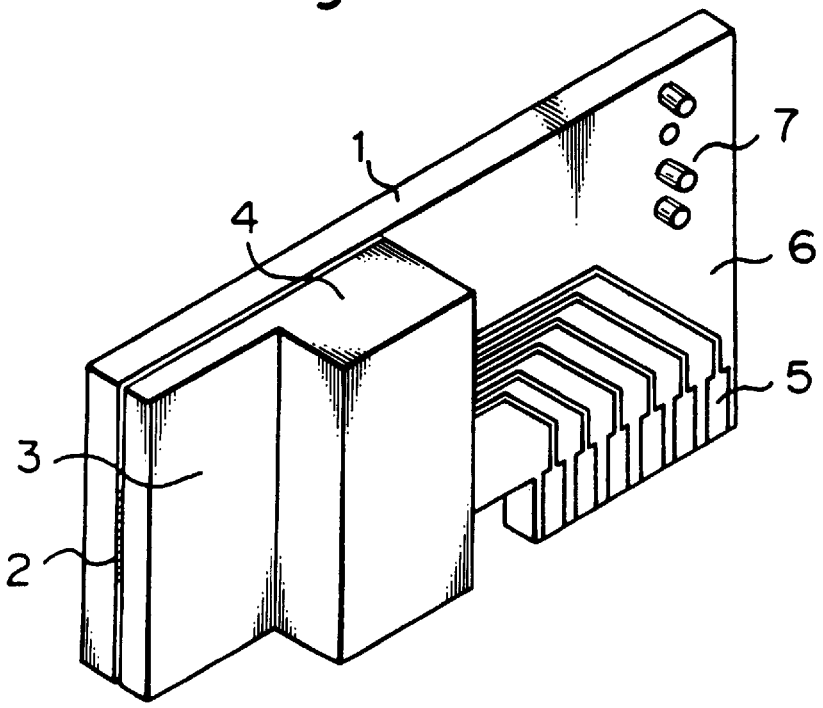
FIG. 1 is a schematic perspective view showing an example of the construction of the liquid ejection recording head of the present invention.

Referring to FIG. 1, which shows the construction of the liquid ejection recording head of the present invention, reference numeral 1 generally designates the liquid ejection recording head. Reference numeral 2 denotes discharge ports for discharging flying droplets, reference numeral 3 designates a liquid flow path constituting portion for constituting liquid flow paths having energy generating elements for generating flying droplets and communicating with the discharge ports 2, reference numeral 4 denotes a liquid chamber constituting portion for constituting a liquid chamber for storing therein liquid to be supplied to the liquid flow paths, and reference numeral 5 designates wires for supplying a driving voltage to the energy generating elements in the liquid flow paths.

Figure 2:
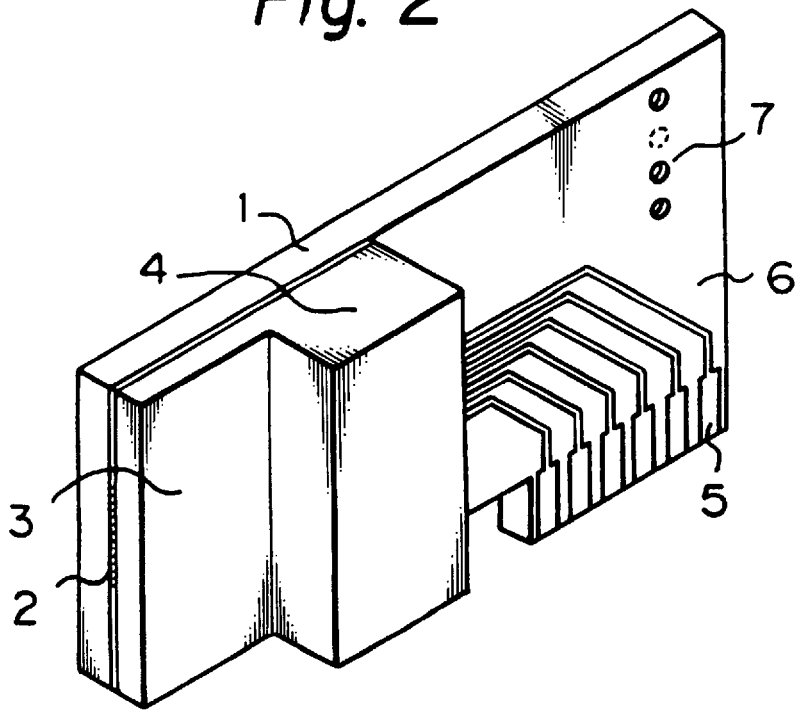
FIG. 2 is a schematic perspective view showing another embodiment of the present invention.

Reference numeral 7 designates a symbol display in which the driving voltage value inherent to the liquid ejection recording head 1 is displayed and recorded in a binary form at a predetermined position on the head. This symbol display 7 actually belongs to a substrate (for example, a substrate of ceramics, glass, plastics or the like) 6 on which the wires 5 are provided, and when the liquid ejection recording head 1 is inspected for shipping by the manufacturer, the protrusions of the symbol display are cut away by pincers or the like in accordance with the driving voltage value inherent to this recording head measured during the inspection, so as to represent binary numbers obtained by transforming the voltage value into a binary form. Thus, the symbol display 7 clearly and accurately displays the driving voltage value inherent to the recording head by binary numbers, for example, with the protrusions as "1" and the positions at which the protrusions have been cut away as "0". FIG. 2 shows another embodiment of the present invention. In FIG. 2, components 1–6 are similar to those in FIG. 1, but the substrate 6 representing the symbol display 7 is initially formed with through-apertures, and these apertures are filled up with an adhesive agent or the like in accordance with the driving voltage value inherent to the recording head when the recording head is inspected for shipping by the manufacturer. In this case, the symbol display 7 is represented, for example, by binary numbers with the apertures as "1" and the positions at which the apertures have been filled up as "0".

The symbol display 7 in the embodiments of FIGS. 1 and 2 uses a 4-bit display, but the meaning of the symbol display will not be changed even if the number of bits is increased or decreased in accordance with the width of the driving voltage and the resolving power on the side which supplies the voltage. Also, a symbol display such as a bar code display is considered to be a symbol transformed into a binary form and therefore, can be applied to the present invention. Also, the binary numbers of these symbol displays 7 can be read by conventional symbol reading means such as a photosensor or a photocoupler, and the driving voltage automatically adjusted on the basis of the driving voltage value of the thus read binary numbers can be supplied to the energy generating elements in the liquid flow paths. Consequently, it becomes unnecessary to adjust the driving voltage generating circuit by hand and also, since the binary numbers are displayed by protrusions or apertures, the inconvenience that the driving voltage value becomes unknown is eliminated.

Figure 3:
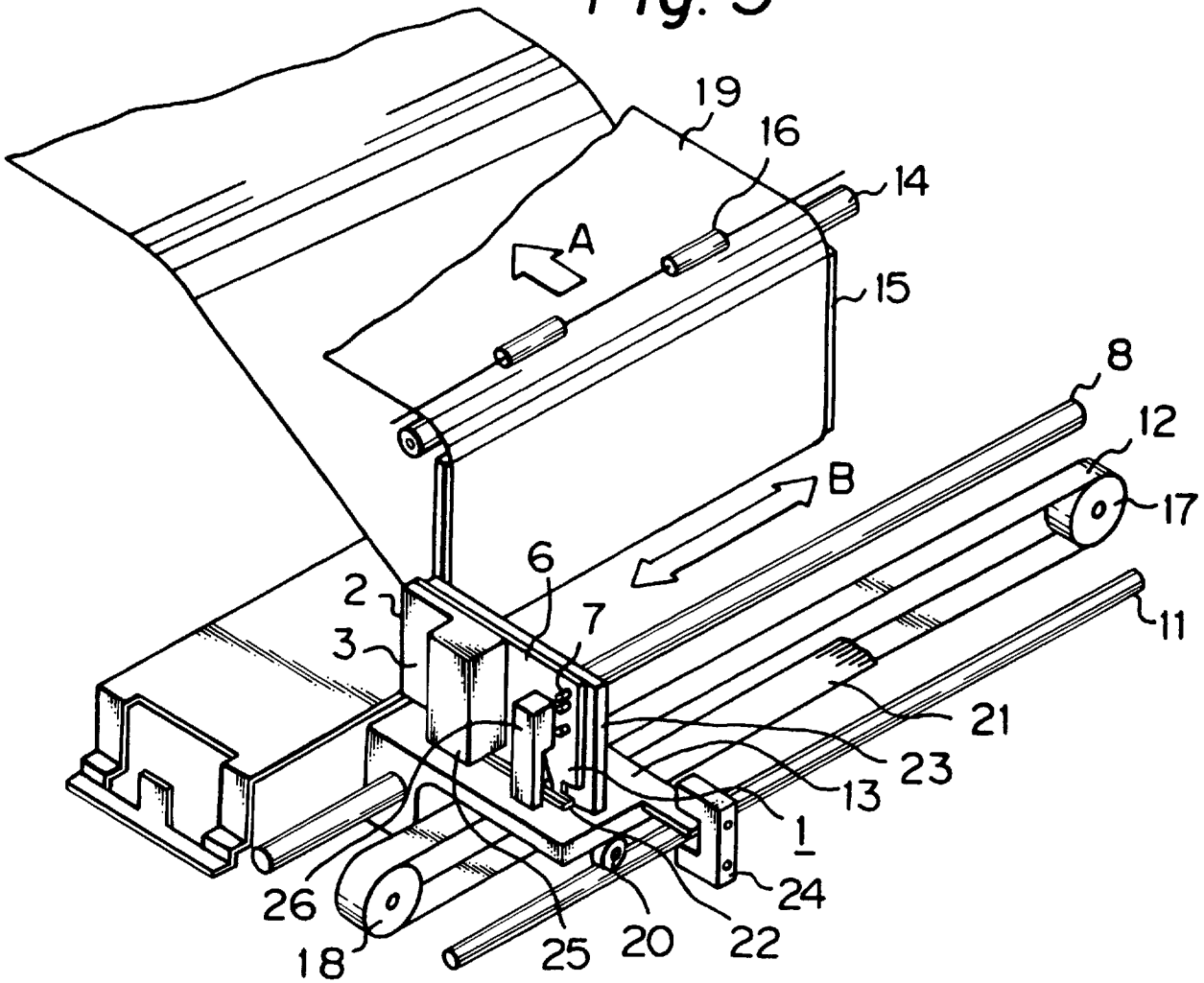
FIG. 3 is a perspective view schematically showing an example of the construction of the liquid ejection recording apparatus of the present invention.

FIG. 3 is a perspective view schematically showing an embodiment of the liquid ejection recording apparatus of the present invention. In FIG. 3, reference numeral 19 designates recording paper. The recording paper 19 is moved on a platen 15 at a predetermined speed in the subsidiary scanning direction (the direction of arrow A) by a paper feeding roller 14 and a pinch roller 16. Reference numerals 17 and 18 denote pulleys supported on respective shafts and rotated by a drive source (not shown). A carriage driving belt 12 is passed over the pulleys 17 and 18.

A carriage 13 is integrally fixed to the carriage driving belt 12. The carriage 13 is guided by guide shafts 8 and 11 and is reciprocally movable in the major scanning directions (the directions of arrow B) by the rotation of the pulleys 17 and 18.

A roller 20 adapted to roll on the guide shaft 11 is disposed on the underside of the carriage 13.

A connector 22 electrically connected to flexible wiring 21 is disposed substantially in the central portion of the carriage 13, and a head aligner 23 for aligning the liquid ejection recording head (hereinafter referred to simply as the recording head) 1 when the wires 5 of the recording head 1 are connected and fixed to the connector 22 is vertically provided on the carriage 13. Accordingly, the recording head 1 is. removable from the carriage 13 by the connector 22. Also, a sensor 24 for detecting the home position of the carriage 13 is provided.

The recording head 1 has a substrate 6, which in turn has thereon discharge ports 2 for discharging ink droplets which are flying droplets, a liquid flow path constituting portion 3 for constituting liquid flow paths communicating with the discharge ports 2 and having energy generating members such as heat generating elements for forming flying ink droplets, and an ink chamber for storing therein ink to be supplied to the liquid flow paths. To the energy generating members of the recording head 1, a driving voltage is supplied from a driving voltage generating circuit 29 shown in FIG. 4 through the connector 22 and the flexible wiring 21 and also, a discharge control signal for controlling the discharge of ink droplets from the discharge ports 2.

Further, the recording head 1 is provided with the symbol display 7 (FIGS. 1 and 2) which is a driving voltage displaying, portion displaying in advance, in binary numbers, the optimum driving voltage inherent to the recording head 1, i.e., the driving voltage supplied to the energy generating members for generating energy utilized to form the flying droplets. The optimum driving voltage displayed by the symbol display 7 (FIGS. 1 and 2) is measured when the recording head 1 is inspected for shipping, and in conformity with the measured value, the symbol display is provided in the form of 4 bits on the substrate 6 represented, for example, by the presence or absence of projections.

Reference numeral 26 designates a reading unit which is provided on the carriage 13 at a position opposed to the symbol display 7 provided on the substrate 6 of the recording head 1 and which reads the display content of the symbol display 7, i.e., the voltage value.

Figure 4:
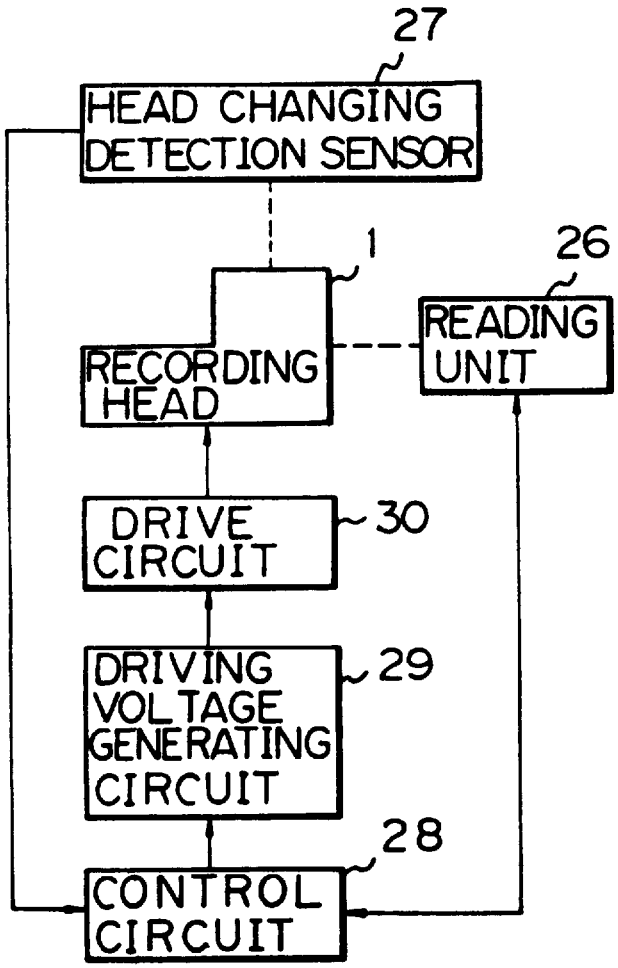
FIG. 4 is a block diagram showing an example of the construction of the electrical system of the apparatus of the present invention.

FIG. 4 is a block diagram showing an example of the electrical system of the apparatus of the present invention.

In FIG. 4, reference numeral 27 designates a head changing detection sensor disposed at a predetermined location in the apparatus so as to detect the changing of the recording head 1. Reference numeral 28 denotes a control circuit actuated by the head changing detection sensor 27 to actuate and control the reading unit 26 and also, control a driving voltage generating circuit 29 so as to generate the voltage displayed at the symbol display 7 of the recording head 1. This control circuit 28 is electrically connected to the head changing detection sensor 27 and the reading unit 26 through the flexible wiring 21. Reference numeral 30 designates a drive circuit for driving the energy generating members of the recording head 1. A driving voltage is supplied to the drive circuit 30 from the driving voltage generating circuit 29.

Figure 5:
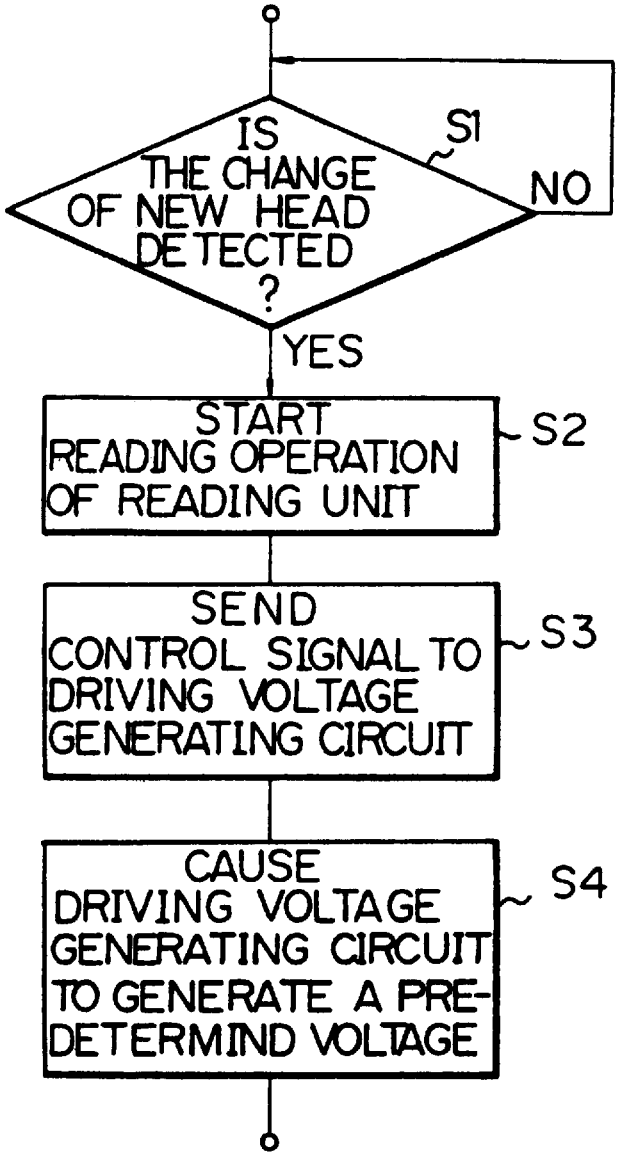
FIG. 5 is a flow chart showing an example of the control process of the control circuit shown in FIG. 4.

The control process of the control circuit 28 shown in FIG. 4 will now be described with reference to the flow chart of FIG. 5.

When the head changing detection sensor 27 detects that the recording head 1 has been newly changed (step S1), the detection output thereof is supplied to the control circuit 28. Subsequently, the control circuit 28 instructs the reading unit 26 to read the-driving voltage displayed at the symbol display 7 of the recording head 1 (step S2).

Then, the control circuit 28 delivers a control signal to the driving voltage generating circuit 29 on the basis of the voltage read from the symbol display 7 by the reading unit 26 so as to generate the same voltage as the driving voltage displayed at the symbol display 7 of the recording head 1 (step S3). In response to this control signal, the driving voltage generating circuit 29 generates the driving voltage displayed at the symbol display 7 of the recording head 1 (step S4), and this voltage is supplied to the drive circuit 30 to enable the energy generating members of the recording head 1 to be driven.

In the above-described embodiment, it has been described that the setting of the driving voltage inherent to the recording head is effected during the changing of the recording head, but instead, it is possible to re-set the driving voltage at each predetermined time in the same recording head. Also, of course, in the liquid ejection recording apparatus of the present invention, the recording head may have a single discharge port or may have a multinozzle having multiple discharge ports. Further, of course, the recording head may be of the type in which a plurality of recording heads are mounted on the carriage.

Furthermore, in the above-described embodiment, the driving voltage display of the recording head has been shown as being in the form of the presence of four projections, but instead, this driving voltage display may be in any form of display. Still further, the reading unit for reading the driving voltage display of the recording head may be of any type if it can read in accordance with the form of the driving voltage display of the recording head.

According to the present invention, as described above, a driving voltage inherent to the liquid ejection recording head mounted on the carriage can be set for each recording head by simple means and therefore, the problem peculiar to the prior art that each time the recording head is mounted or changed, the driving voltage thereof must be adjusted is greatly alleviated and thus, the operability of the recording head can be improved much more.

Figure 6:
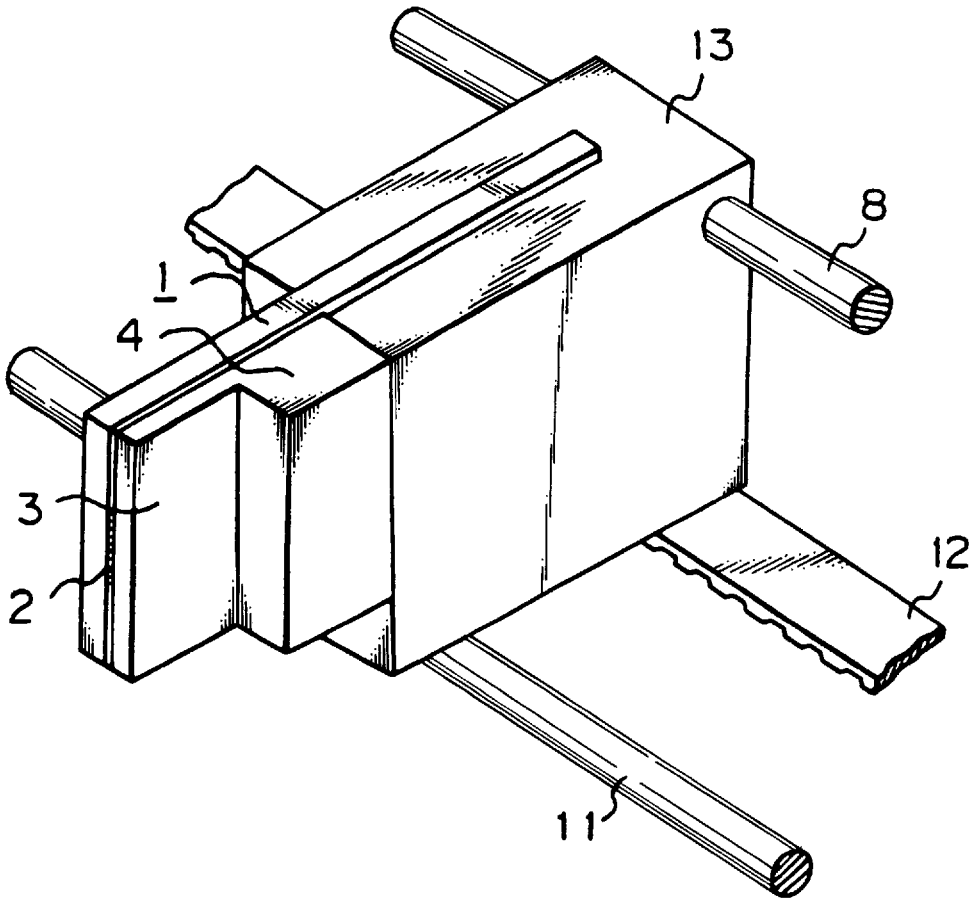
FIG. 6 is a schematic perspective view showing another example of the construction of the essential portions of the liquid ejection recording apparatus of the present invention.

FIG. 6 is a schematic perspective view showing an example of the construction of the essential portions of a liquid ejection recording apparatus on which the recording head shown in FIG. 2 is mounted. Reference numerals indicated in FIG. 6 are similar in significance to those indicated in FIGS. 1 to 3. In FIG. 6, reference numerals 8 and 11 designate guide rails for scanning the carriage 13, which is moved along a recording medium, not shown, by the belt 12.

The liquid ejection recording head 1 is fitted and fixed to a fitting portion provided on the carriage 13. Reading means for reading the symbol recorded on the head 1 is provided in the carriage 13.

Figure 7:
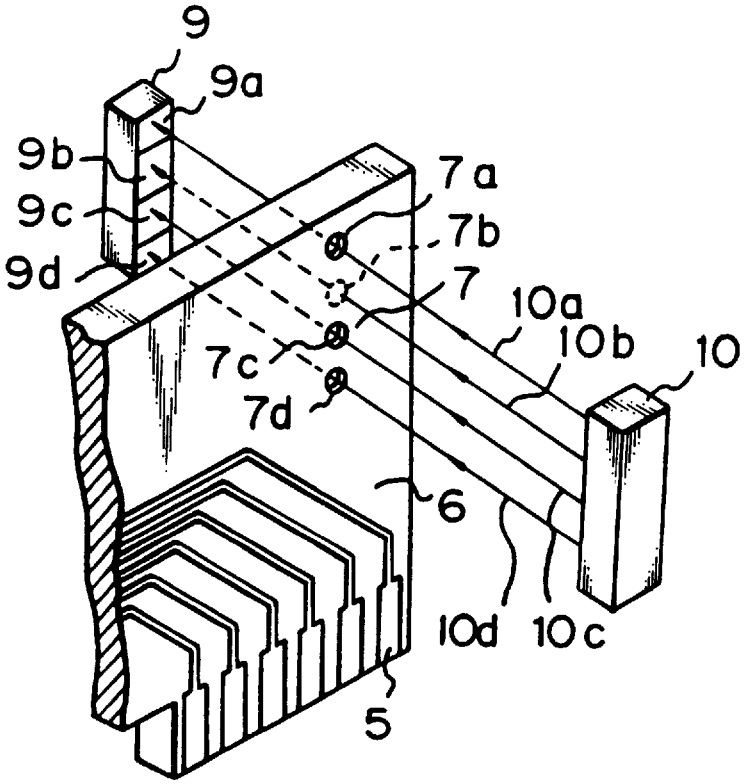
FIG. 7 is a schematic perspective view for illustrating the reading means of the liquid ejection recording apparatus shown in FIG. 6.

FIG. 7 is a schematic perspective view showing an example which uses optical means as the symbol reading means. In FIG. 7, reference numeral 9 designates a photosensor for detecting light. The photosensor 9 may suitably be a photodiode, a photo-transistor or the like. Light entering the photosensor 9 is applied by illuminating means (light-emitting means) 10.

In FIG. 7, the symbol display 7 is in the form of through-apertures formed in the substrate 6, except 7*b*. Accordingly, light beams 10*a*–10*b* emitted by the illuminating means 10 enter cells 9*a*–9*d* provided correspondingly to the symbol displays 7*a*–7*d* of the photosensor 9 except the symbol display 7*b*. (In FIG. 7, no light enters the cell 9*b*). By this, which of the symbol displays are transparent to the light and which of the symbol displays are not is detected and by the detected information, the driving voltage of the recording head is adjusted to an optimum value or an optimum range.

In FIG. 7, the photosensor 9 and the illuminating means 10 are spaced apart from the display symbols, but it is preferable from the viewpoint of the compactness of the apparatus that they be installed so as to be substantially in intimate contact with the substrate 6.

The detected information may not only be automatically adjusted, but also may indicate the driving voltage value to the display means and may be manually adjusted. When the detected information is manually adjusted, the driving voltage can be adjusted very simply if, for example, the display means is made to effect a bar graph display or a pointer display so that adjustment can be effected by adjusting the pointer of the volume, or the like, to the position thereof.

According to the present invention, as described above, the driving voltage value inherent to each liquid ejection recording head can be clearly and accurately displayed by simple means and moreover, the occurrence of the trouble that the driving voltage value disappears or is lost during the transportation of the head is eliminated, and how to adjust the driving voltage generating circuit when actually changing the head can be judged at a glance. Also, cumbersome adjustment is unnecessary, and if the mounting of the recording head is done properly, stable image recording can always be accomplished.

Not only is the optimum driving voltage of the head displayed by the utilization of protrusions or apertures, but also the display corresponding to the type of the liquid contained in the head (for example, the color or the ink corresponding to the recording medium) may be added. In this latter case, it is also preferably to display the type of the liquid on the apparatus body side.

The symbolized portions are not restricted to protrusions or apertures as described above, but may be cut-away or other concave portions provided in a head constituting member (for example, the substrate) or electrical conductive portions provided separately from those connected to the energy generating members. The reading of those portions may suitably be accomplished not only by optical means utilizing the transmission or reflection of light as described above, but also by mechanical means for detecting the mechanical displacement resulting from the contact or fitting between the binarized symbol portion and the apparatus body (for example, a switch or a piezoelectric element which is a mechanico-electric converting member) or electrical means effected by detecting any variation in electrical resistance value (for example, the electrical connection by contacts or the like).

Figure 8:
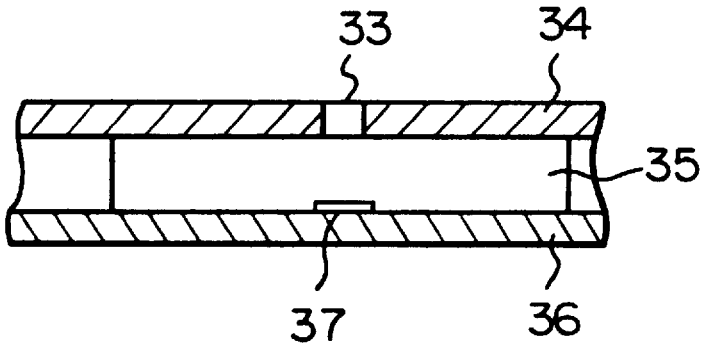
FIG. 8 is a partially sectional view for showing the construction of the liquid ejection recording head.

FIG. 8 shows the constitution of the liquid ejection recording head in which reference numeral 33 denotes an orifice from which a liquid flying droplet generated by a energy generating member 37, and is provided in an orifice plate 34.

The liquid needed for forming the droplets is supplied through a flow path 35.

Figure 9A:
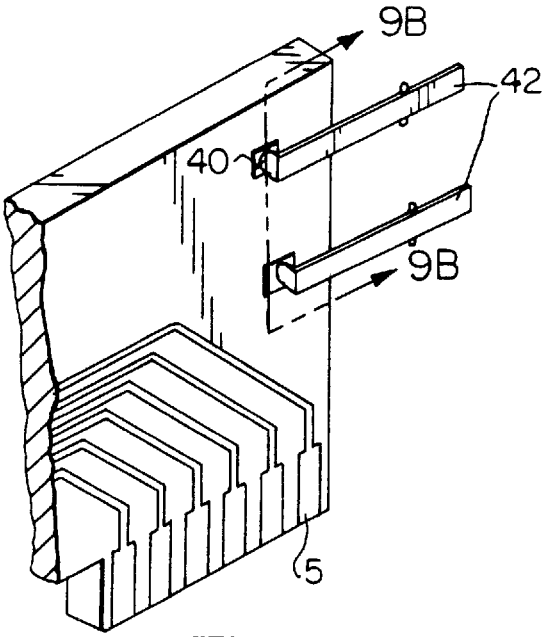
FIG. 9 comprising FIGS. 9A (perspective view) and 9B (cross-section from line 9B—9B of FIG. 9A), shows another embodiment.
Figure 9B:
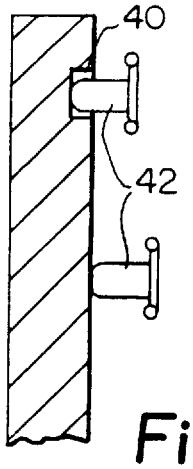
Figure 10:
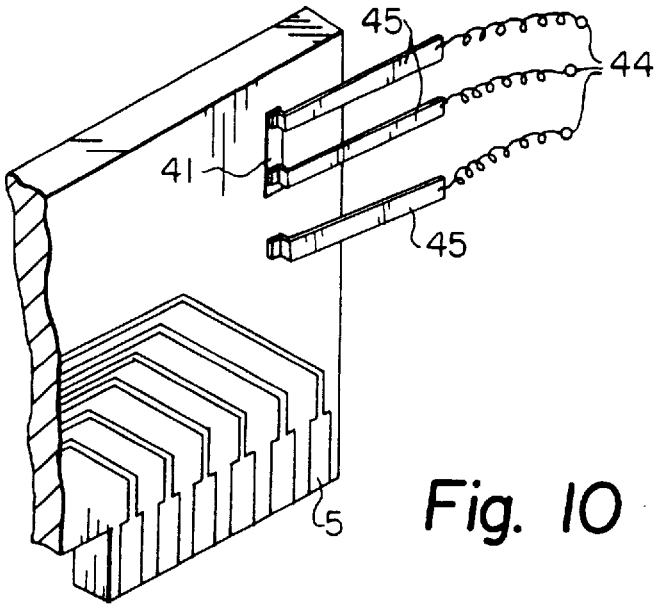
FIG. 10 shows another embodiment of the invention.
Figure 11:
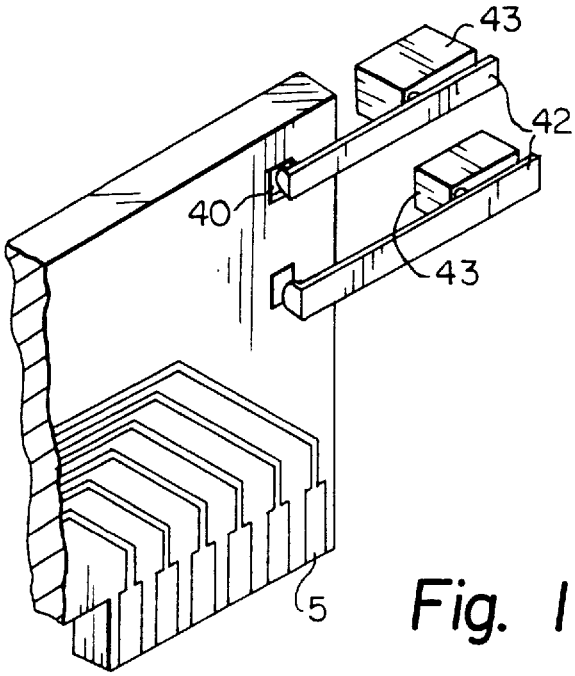
FIG. 11 shows another embodiment of the invention.

The symbolizing portions are not restricted to protrusions or apertures as described above, but may be cut-away or other concave portions 40, as shown in FIGS. 9A and 9B, provided in a head constituting member (for example, the substrate) or electrically conductive portions 41 provided separately from those connected to the energy generating members, as shown in FIG. 10. The reading of such symbolizing portions may suitably be accomplished not only by optical means utilizing the transmission or reflection of light as described above, but also by the mechanical means 42 shown in FIGS. 9 and 11 that detect mechanical displacement resulting from the contact or fitting between the binarized symbolizing portion and the apparatus body (for example, by using the switches 43, or another mechanico-electrical converting member such as a piezoelectric element, as shown in FIG. 11), or by the electrical means 44 shown in FIG. 10 that detect variations in electrical resistance (for example, through the electrical connections made by the contacts 45 or the like).

What I claim is:

1. A recording apparatus for recording using a removable recording head having an operation data storing means for storing a data regarding operation thereof, said apparatus comprising:

a carriage for removably mounting said recording head;

detecting means for detecting changing of said recording head on said carriage, said detecting means outputting a detection output when said recording head is newly-changed;

read-out means for reading out from said recording head the data regarding operation of said recording head mounted on said carriage in response to an instruction; and a control circuit that receives the detection output from said detecting means and which in response sends the instruction to the read-out means so that the data regarding operation is read out by said read-out means, said control circuit setting an operation condition of said recording head mounted on said carriage in response to the data regarding operation read out by said read-out means.

2. An apparatus according to claim 1, wherein said recording head discharges an ink.

3. An apparatus according to claim 2, wherein said recording head discharges the ink by utilizing thermal energy.

4. An apparatus according to claim 3, wherein said recording head has a resistant member for generating thermal energy.

5. An apparatus according to claim 2, wherein said operation data indicates a color of the ink contained in said recording head.

6. An apparatus according to claim 1, wherein said operation data indicates a drive voltage of said recording head.

7. An apparatus according to claim 6, wherein said control means sets the drive voltage of said recording head.

8. An apparatus according to claim 7, further comprising voltage generating means for generating a voltage in response to the drive voltage set in accordance with said control means.

9. An apparatus according to claim 1, wherein said operation data is binarized.

10. An apparatus according to claim 1, wherein said read-out means mechanically reads out said operation data.

11. An apparatus according to claim 1, wherein said read-out means optically reads out said operation data.

12. An apparatus according to claim 1, wherein said read-out means electrically reads out said operation data.

13. A recording method for recording using a removable recording head having an operation data storing means for storing a data regarding operation thereof that is removably mounted on a carriage, said method comprising the steps of:

detecting changing of said recording head on said carriage;

outputting, as a result of the detecting of the changing of said recording head, a detection output;

reading out from said recording head in response to the outputting of the detection output the data regarding operation of said recording head mounted on said carriage;

setting an operation condition of said recording head mounted on said carriage in response to the data regarding operation read out in said reading_out step; and moving said recording head for recording under the operation condition set in said setting step.

14. A method according to claim 13, wherein said recording head discharges an ink.

15. A method according to claim 14, wherein said recording head discharges the ink by utilizing thermal energy.

16. A method according to claim 15, wherein said recording head has a resistant member for generating thermal energy.

17. A method according to claim 13, wherein said operation data indicates a color of the ink contained in said recording head.

18. A method according to claim 13, wherein said operation data indicates a drive voltage of said recording head.

19. A method according to claim 18, wherein at said setting step the drive voltage of said recording head is set.

20. A method according to claim 13, wherein said operation data is binarized.

21. A method according to claim 13, wherein at said read-out step said operation data is mechanically read out.

22. A method according to claim 13, wherein at said read-out step said operation data is optically read out.

23. A method according to claim 13, wherein at said read-out step said operation data is electrically read out.

* * * * *

UNITED STATES PATENT AND TRADEMARK OFFICE

CERTIFICATE OF CORRECTION

PATENT NO. : 5,870,113

DATED : February 9, 1999

INVENTOR(S) : YUTAKA KOIZUMI

It is certified that error appears in the above-identified patent and that said Letters Patent is hereby corrected as shown below:

On the title page: Item

[56] REFERENCES CITED

U.S. Patent Documents
"Philips" should read --Phillips--.

[]57] ABSTRACT

Line 9, "sense" should read --senses--.

COLUMN 1

Line 58, "un-necessary" should read --unnecessary--.

COLUMN 3

Line 3, "trouble" should read --problem--.

COLUMN 5

Line 33, "is," should read --is--.
Line 52, "displaying, portion displaying" should read --displaying portion displaying,--.

UNITED STATES PATENT AND TRADEMARK OFFICE

CERTIFICATE OF CORRECTION

PATENT NO. : 5,870,113

DATED : February 9, 1999

INVENTOR(S) : YUTAKA KOIZUMI

It is certified that error appears in the above-identified patent and that said Letters Patent is hereby corrected as shown below:

COLUMN 6

Line 25, "the-driving" should read --the driving--.

COLUMN 8

Line 13, "generated" should read --is generated--.

COLUMN 10

Line 3, "reading___out" should read --reading out--.

Signed and Sealed this

Seventh Day of December, 1999

*Attest:*

*Attesting Officer*

Q. TODD DICKINSON

*Acting Commissioner of Patents and Trademarks*